United States Patent [19]

Imafuku et al.

[11] Patent Number: 4,890,794

[45] Date of Patent: Jan. 2, 1990

[54] PERFORATED BODY FOR A FUEL INJECTION VALVE

[75] Inventors: Ichiei Imafuku, Kanagawa, Japan; Waldemar Hans, Bamberg, Fed. Rep. of Germany

[73] Assignee: Robert Bosch GmbH, Stuttgart, Fed. Rep. of Germany

[21] Appl. No.: 242,663

[22] Filed: Sep. 12, 1988

[30] Foreign Application Priority Data

Oct. 5, 1987 [DE] Fed. Rep. of Germany ..... 3733604

[51] Int. Cl.[4] ..... F02M 61/18; F02M 51/06

[52] U.S. Cl. ..... 239/533.12; 239/585

[58] Field of Search ..... 239/585, 533.12, 533.3, 239/499

[56] References Cited

U.S. PATENT DOCUMENTS 4,532,906 8/1985 Höppel ..... 239/585

4,627,772 11/1986 Blythe et al. ..... 239/585

4,646,974 3/1987 Sofianek et al. ..... 239/533.12

4,699,323 10/1987 Rush et al. ..... 239/585

*Primary Examiner*—Andres Kashnikow

*Assistant Examiner*—Karen B. Merritt

*Attorney, Agent, or Firm*—Edwin E. Greigg

[57] ABSTRACT

In known fuel injection valves, perforated bodies are secured downstream of the valve sealing seat and are provided with injection openings the size of which meters the quantity of fuel injected. The novel perforated body is intended to enable simple adjustment of the size of these injection openings. The perforated body has a plurality of injection openings, which by their geometry meter the quantity of fuel flowing through them and aim the injected fuel stream. The provision of steps in the form of grooves, blind bores or wedge-shaped notches, in flat sides of the perforated body defines the length of individual injection openings. The perforated body is suitable for use in fuel injection valve of fuel injection systems of internal combustion engines.

14 Claims, 3 Drawing Sheets

FIG. 3a
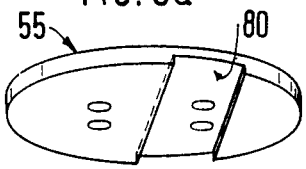
FIG. 3b
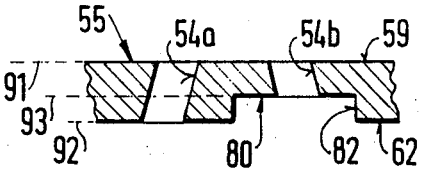
FIG. 4a
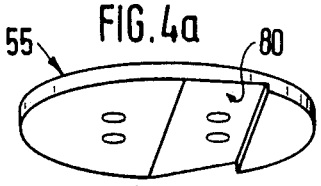
FIG. 4b
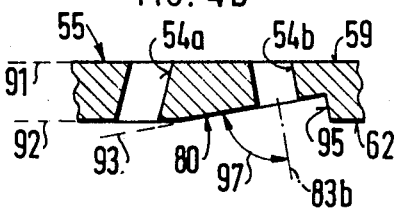
FIG. 5a
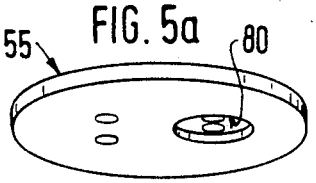
FIG. 5b
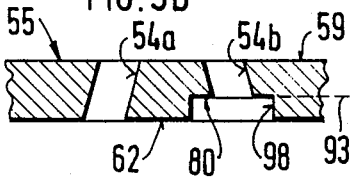
FIG. 6a
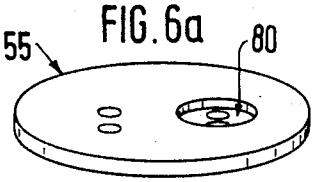
FIG. 6b
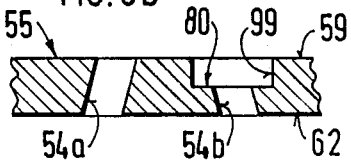
FIG. 7a
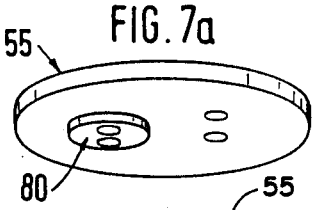
FIG. 7b
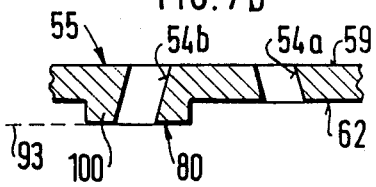
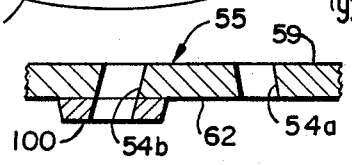
FIG. 8

PERFORATED BODY FOR A FUEL INJECTION VALVE

BACKGROUND OF THE INVENTION

The invention is directed to improvements in fuel injection valves for fuel injection systems of internal combustion engines in which a perforated body is provided downstream of the valve seat.

A fuel injection valve for use in an internal combustion engine is already known in which a perforated body having a plurality of aimed bores is disposed downstream of the valve seat. The bores begin in an annular groove, which is machined into the flat side of the perforated body oriented toward the valve seat, and they discharge on the other flat side of the perforated body. They are inclined such that the emerging fuel streams have a spin. For adaptation of the fuel quantity supplied to the fuel injection valve, the number of the various bores and their diameter are adapted to the individual setting requirements. In the known perforated body, there is no provision for any more extensive adjustment of the injection characteristic, and in particular, no provision for adaptation to specialized configurations and flow conditions of the engine.

OBJECT AND SUMMARY OF THE INVENTION

It is a principal object of the invention to provide a perforated body having the advantage of simple, individualized adaptation to the particular features of the engine. In particular, engine-specific properties such as its type, flow conditions and operating ranges can already be taken into account at the time of manufacture of the fuel injection valve, so that adaptation even within a single production line is possible.

It is another object of the invention and particularly advantageous to incline the injection openings variously with respect to the longitudinal axis of the fuel injection valve. This inclination action makes it possible for instance to aim the fuel streams at a plurality of independent inlet conduits of the engine.

The invention will be better understood and further objects and advantages thereof will become more apparent from the ensuing detailed description of preferred embodiments taken in conjuction with the drawings.

BRIEF DESCRIPTION OF THE DRAWINGS

FIGS. 3–7 show various perforated bodies, in each case in a perspective view (a) and in section (b); and FIG. 8 illustrates a cross sectional view of a perforated part adhered to a face thereof.

DESCRIPTION OF THE PREFERRED EMBODIMENTS

Figure 1:
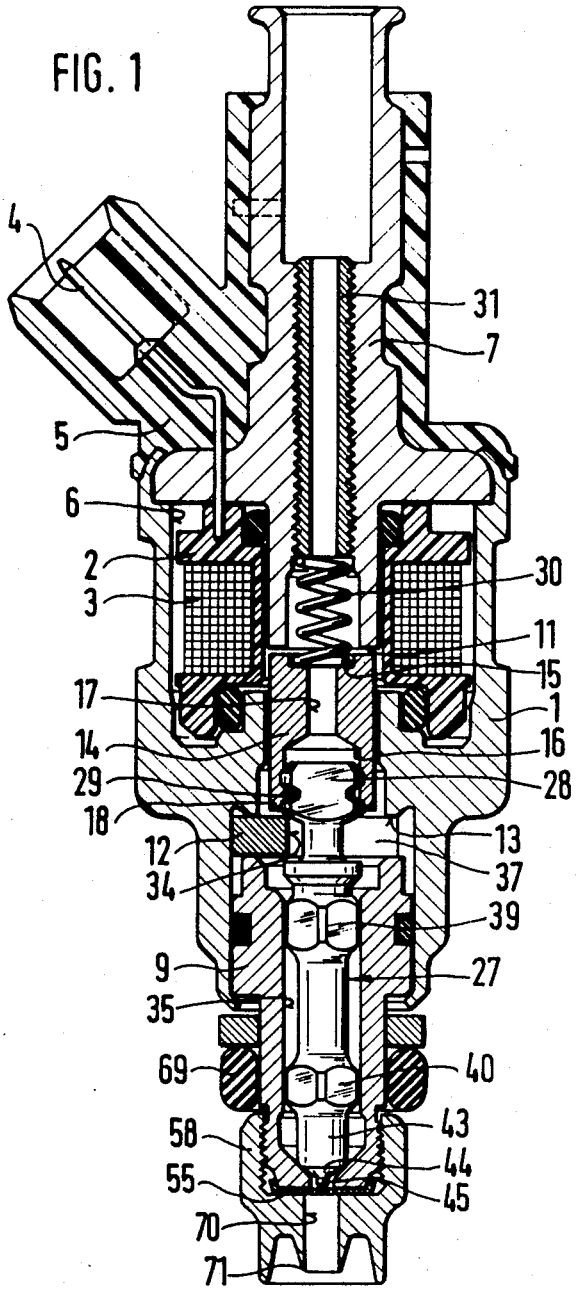
FIG. 1 shows one embodiment of a fuel injection valve provided with the perforated body according to the invention.

A fuel injection valve for a fuel injection system of a mixture-compressing internal combustion engine having externally supplied ignition, shown by way of example in FIG. 1, has a valve housing 1 of ferromagnetic material, in which a magnet coil 3 is disposed on a coil holder 2. The magnet coil 3 is supplied with current via a plug connection 4, which is embedded in a plastic ring 5 partly surrounding the valve housing 1.

The coil holder 2 of the magnet coil 3 sits in a coil chamber 6 of the valve housing 1 on a connection fitting 7 carrying the fuel, such as gasoline, which protrudes partway into the valve housing 1. Remote from the fuel fitting 7, the valve housing 1 partly surrounds a nozzle holder 9.

A cylindrical armature 14 is located between one end face 11 of the connection fitting 7 and a stop plate 12, which for accurate adjustment of the valve has a predetermined thickness, and which is mounted on an inner shoulder 13 of the valve housing 1. The armature 14 is made of a noncorroding magnetic material and is disposed coaxially in the valve housing 1, spaced slightly apart radially from a magnetically conductive step of the valve housing 1, thus forming an annular magnetic gap between the armature 14 and the step. The cylindrical armature 14 is provided with a first and second coaxial blind bore 15 and 16, respectively, extending from its two end faces, the second blind bore 16 opening toward the nozzle body 9. The first and second blind bore 15 and 16 communicate with one another through a coaxial opening 17. The diameter of the opening 17 is less than the diameter of the second blind bore 16. The end portion of the armature 14 oriented toward the nozzle body 9 is embodied as a deformation zone 18. The purpose of this deformation zone 18 is to join the armature 14 in a form-fitting manner with a valve needle 27, by gripping about a retaining body 28 that forms part of the valve needle 27 and fills the second blind bore 16. This gripping action of the deformation zone 18 of the armature 14 on the retaining body 28 is achieved by forcing material comprising the deformation zone 18 into grooves 29 located on the retaining body 28.

A compression spring 30 rests with one end on the bottom of the first coaxial blind bore 15, and on its other end it rests on a tube insert 31, which is secured in the connection fitting 7 by being screwed into it or wedged into it, and which tends to exert a force oriented away from the connection fitting 7 upon the armature 14 and valve needle 27.

The valve needle 27 passes through a through bore 34 in the stop plate 12 with a radial clearance and is guided in a guide bore 35 of the nozzle body 9. A recess 37 is provided in the stop plate 12, leading from the through bore 34 to the periphery of the stop plate 12, and its inside width is greater than the diameter of the valve needle 27 in the region in which the valve needle is surrounded by the stop plate 12.

The valve needle 27 has two guide sections 39 and 40, which lend guidance to the valve needle 27 in the guide bore 35 and also leave an axial passageway free for the fuel. These guides sections are for example embodied as squares.

The second guide section 40, located downstream of the first, is adjoined by a cylindrical section 43 of lesser diameter. The cylindrical section 43 is adjoined in turn by a conically tapering section 44, which terminates in a coaxial, preferably cylindrical tang 45.

Figure 2:
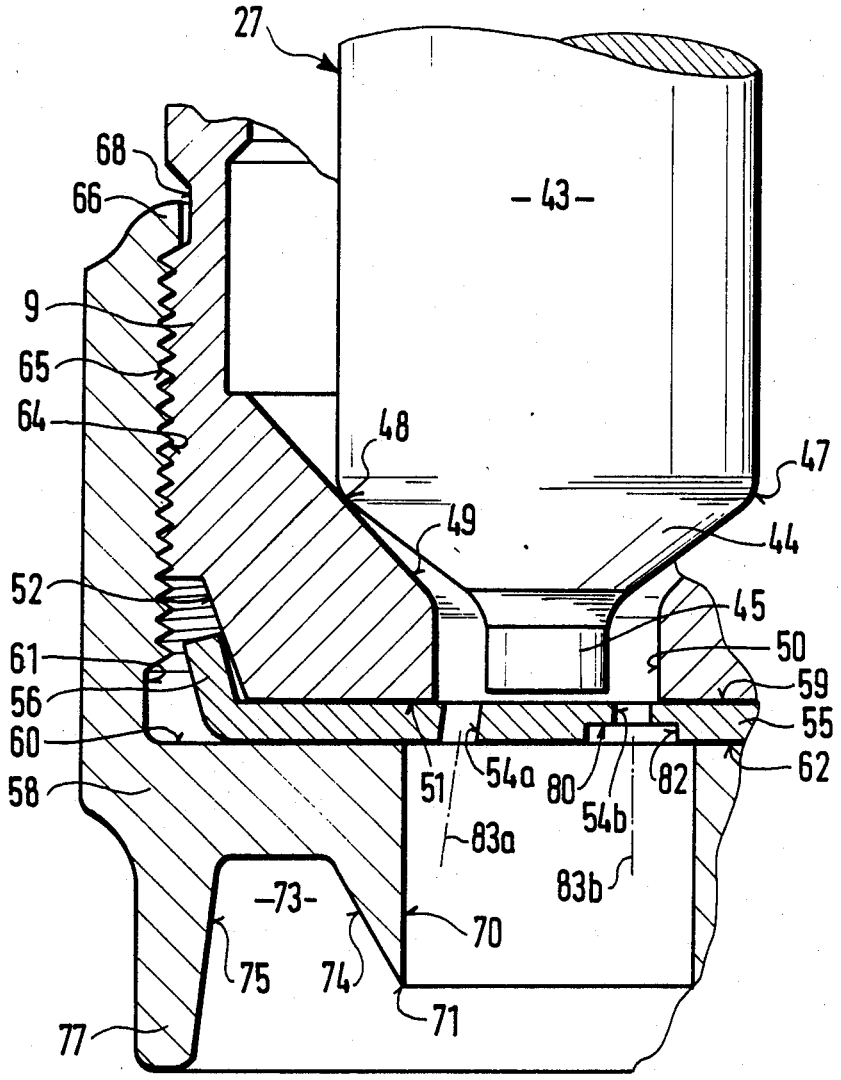
FIG. 2 is a detail of FIG. 1 shown on a larger scale.

In FIG. 2, which shows a detail of FIG. 1 it can be seen that the transition between the cylindrical section 43 and the conical section 44 is rounded, approximately in the form of a radius, and forms a sealing section 47, which in cooperation with a valve seat 48 on a conical valve seat face 49 of the nozzle body 9 effects an opening or closing of the fuel injection valve. The conical valve seat face 49 of the nozzle body 9 continues, in the direction remote from the armature 14, in the form of a cylindrical nozzle body opening 50, which extends for approximately the same length as the length of the tank 45, so that an annular gap of constant cross section remains between the cylindrical nozzle body opening 50 and the cylindrical tang 45. The transitions between the conical valve seat face 49 on the one hand and the conical section 44 of the valve needle 27 on the other are rounded, in order to assure a good flow course. The nozzle body 9 is terminated in the direction remote from the armature 14 by a flat side 51, which is interrupted by the mouth of the nozzle body opening 50.

The length of the tang 45 is dimensioned such that with the fuel injection valve closed, the tang 45 is just short of protruding out of the nozzle body opening 50; that is, the tang 45 terminates immediately upstream of the plane defined by the flat side 51 of the nozzle body 9. While the flat side 51 of the nozzle body 9 is limited on the inside by the nozzle body opening 50, it may be limited on the outside by a conical zone 52, which widens in the direction toward the armature 14.

A perforated body 55, provided with injection openings 54*a, b* and for instance embodied as a thin lamina, rests on the flat side 51 of the nozzle body 9. The perforated body 55 may either be entirely flat, or as shown in the drawing it may be provided with a bent rim 56, which approximately follows the contour of the conical zone 52 of the nozzle body 9. The rim 56 of the perforated body 55 may for instance be produced by deep-drawing of the perforated body 55. The fastening of the perforated body 55 to the flat side 51 is assured by means of a preparation sleeve 58. The perforated body 55 is engaged in an outer region, on a second face 62 remote from the sealing section 47, by the bottom 60 of a coaxial blind bore 61 of the preparation sleeve 58, which presses the perforated body 55, with a first face 59 oriented toward the sealing section 47, against the flat side 51 of the nozzle body 9. That is, the perforated body 55 is clamped between the bottom 60 of the blind bore 61 of the preparation sleeve 58 and the flat side 51 of the nozzle body 9. Centering of the perforated body 55 is attained by the application of its rim 56 against the conical region 52 of the nozzle body 9, so that the perforated body 55 has no further radial play. Particularly good centering of the perforated body 55 is attainable if the rim 56 of the perforated body 55 spreads apart upon being slipped over the conical zone 52, in other words being radially clamped in place.

The clamping of the perforated body 55 on its faces 59, 62 between the nozzle body 9 and the preparation sleeve 58 is accomplished by screwing an internal thread 64 of the preparation sleeve 58 onto an external thread 65 machined into the circumference of the nozzle body 9. To secure the position of the preparation sleeve 58 relative to the nozzle body 9 after they have been screwed together, the preparation sleeve 58 may be braced with a bracing protrusion 66 in an external groove 68 of the nozzle body 9. The rim of the preparation sleeve 58 oriented toward the armature 14 is used as the bracing protrusion 66. The jacket face of the blind bore 61, which is embodied over nearly its entire length by the internal thread 64, extends between the rim forming the bracing protrusion 66 and the bottom 60 of the preparation sleeve 58. The internal thread 64 and the external thread 65 are preferably embodied as fine threads. The preparation sleeve 58 can at the same time serve as a means of axially securing a sealing ring 69 radially encompassing the nozzle body 9, as shown in FIG. 1.

A preparation bore 70 of preferably cylindrical cross section discharges at one end coaxially in the bottom 60 of the preparation sleeve 58 and at the other in a sharp preparation edge 71. The preparation edge 71 is surrounded by an annular groove 73. The cross section of the annular groove 73 is approximately trapezoidal in the exemplary embodiment shown; that is, an inner wall 74 and an outer wall 75 of the annular groove 73 are disposed oblique to one another. The preparation edge 71 is embodied by the acute angle between the oblique inner wall 74 of the annular groove 73 and the preparation bore 70. This angle should be between 10 and 20°. The outer wall 75 of the annular groove 73 at the same time forms the inner face of a collar 77. The collar 77 is the part of the fuel injection valve that protrudes farthest in the direction remote from the armature 14. Th collar 77 surrounds the preparation edge 71 and at the same time protrudes beyond it. The purpose of the collar 77 is to protect the recessed preparation edge 71 from damage, for instance when the fuel injection valve is being installed on an engine.

The perforated body 55 is provided with a plurality of injection openings 54*a, b*, which are embodied in particular as bores and lead from upstream to downstream of the perforated body 55. The injection openings 54*a, b* may all have the same diameter or may have different diameters. The injections openings 54*a, b* are also of various lengths, such that depending on the exemplary embodiment, the injection openings 54*b* are shorter or longer than the further injection openings 54*a*. Upstream of the perforated body 55, in the exemplary embodiment of FIG. 2, the injection openings 54*a, b* in the first face 59 open into the annular space formed between the nozzle body opening 50, the tang 45 and the exposed portion of the first face 59. Down-stream of the perforated body 55, the further injection openings 54*a* discharge on the exposed portion, surrounded by the preparation bore 70, of the second face 62, while the injection openings 54*b* discharge in a step 80, which is embodied on the exposed portion of the second face 62 of the perforated body 55 and is offset from the second face 62. In the exemplary embodiment of FIG. 2, the step 80 is embodied as a bottom of an elongated groove 82 extending vertically of the plane of the drawing between the faces 59, 62.

The injection openings 54*a, b* have center axes 83*a, b*, which may extend inclined to or parallel to the longitudinal axis of the fuel injection valve. The inclination of each center axis 83*a* of the further injection openings 54*a* relative to the longitudinal axis of the fuel injection valve may have both a radial and a tangential component. The center axes 83*b* of the injection openings 54*b* are shown extending axially, in the exemplary embodiment of FIG. 2.

When current is flowing through the magnet coil 3, the armature 14 is attracted in the direction toward the connection fitting 7. With its sealing section 47, the valve needle 27, which is firmly connected to the armature 14, lifts up from the conical valve seat face 49. Between the sealing section 47 and the valve seat 48 of the conical valve seat face 49, a flow cross section is opened up, and the fuel can flow through the annular space located between the nozzle body opening 50 and the tang 45 to reach the injection openings 54*a, b*. The injection openings 54*a, b* are subjected to a flow of fuel through them with a high pressure drop, since they form the narrowest flow cross section inside the fuel injection valve. The geometry of the injection openings 54*a, b* thus determines the flow quantity of the injected fuel; by those skilled in the art, this is called "metering".

The aiming, or alignment, of the injection openings 54*a, b,* or in other words the position of their center axes 83*a, b,* is adaptable to a given application. Normally the injection openings 54*a, b* are aimed to meet the hot inlet valve of the engine precisely. When they are used in an engine having two inlet valves per cylinder, however, the injection openings 54*a, b* can in particular be aimed at different inlet valves.

Some examples of embodiments of the perforated body 55 according to the invention are shown in FIGS. 3–7. The rim 56 of the perforated body 55 shown in FIG. 2 is not shown in FIGS. 3–7. The reference numerals in FIGS. 3–7 correspond to those used earlier, for elements functioning in the same way.

FIGS. 3*a, b* show the same embodiment of the perforated body 55 as described above. The groove 82 is machined into the second face 62 of the perforated body 55 outside the axis of symmetry, interrupting this face. If the first, upstream-facing face 59 of the perforated body 55 is imagined as being located in a first plane 91, and the second, downstream-facing face 62 as being located in a second plane 92, then the flat bottom, which forms the step 80, of the elongated groove 82 is located in a a third plane 93, parallel to and between the planes 91, 92. While each of the further injection openings 54*a* discharges at one end in the first plane 91 and at the other in the second plane 92, each of the injection openings 54*b* extends from the first plane 91 as far as the step 80 in the third plane 93.

In the case of the perforated body 55 shown in FIGS. 4*a, b,* the downstream-facing second face 62 is interrupted by a wedge-shaped notch 95. The bottom, forming the step 80, of the wedge-shaped notch 95, at which the injection openings 54*b* discharge, defines the third plane 93, which extends at an angle from the first and second planes 91 and 92. It may be advantageous to embody the wedge-shaped notch 95 such that the center axes 83*b* of the injection openings 54*b* extend at a right angle 97 with respect to the third plane 93 or to the step 80 of the wedge-shaped notch 95. Because the fuel stream emerges at right angles to the step 80, the stream remains particularly uniform.

In the perforated body 55 shown in FIGS. 5*a, b,* the step 80 is embodied as the bottom of a blind bore 98, which extends from the downstream-facing second face 62. The injection openings 54*b* extend between the first face 59 and the step 80.

In the perforated body 55 shown in FIGS. 6*a, b,* a blind bore 99 is provided which extends from the upstream-facing first face 59 and the bottom of which forms the step 80, between which and the second face 62 the injection openings 54*b* extend.

As shown in FIGS. 7*a, b,* the step 80 may also be embodied as a protrusion 100 protruding beyond the faces 59, 62. In contrast to the foregoing exemplary embodiments, in this case the injection openings 54*b* extending between the step 80, or the third plane 93, and one of the faces 59, 62 are longer than the further injection openings 54*a* extending between the first face 59 and the second face 62.

In the exemplary embodiments described, the further injection openings 54*a* each extend between the first face 59 and the second face 62.

In the perforated body 55 shown in FIG. 8, it is particularly advantageous to embody it in two parts, in which the protrusion 100, having the shape of a platform, is embodied as a separate part and mounted on one of the faces 59, 62 of the perforated body 55.

The perforated body can be produced by embossing, grinding, lathing, electrolytic grinding, or some similar process, while the injection openings can be produced by erosion, stamping or boring (also laser boring or electron beam boring). Various kinds of metals, especially sintered metals, as well as plastics and ceramics are possible as materials for the perforated body. In a further embodiment of the invention the perforated body 55 may also be embodied as a component part of the nozzle body 9, for example as the bottom of the nozzle body 9.

By providing the steps 80 in the perforated body 55, a change in the length of the injection openings discharging in this region is brought about. Since the length of the injection openings determines the pressure drop at them (given the same diameter, long injection openings dictate a large pressure drop and short injection openings dictate a smaller pressure drop), a suitably selected location of the step makes it possible to determine the pressure drop at the particular injection opening and thus to determine the quantity of fuel flowing through it. For adapting the fuel quantity in a fuel injection valve, either the number of injection openings can be varied, or the flow quantity of each injection opening can be varied as described above.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A perforated body for use downstream of a valve seat of a fuel injection valve for fuel injection systems of internal combustion engines, having a first face (59) located in a first plane, a second face (62) located in a second plane, and at least one step located in a third plane, between which step and one of said first and second faces, at least one injection opening extends penetrating the perforated body, at least one further injection opening (54*a*) extends between the two faces (59, 62) from said first face (59) to said second face (62), and a length of the at least one further injection opening (54*a*) differs from a length of the at least one injection opening (54*b*) extending between the step (80) and one of said first and second faces (59, 62).

2. A perforated body as defined by claim 1, in which the step (80) comprises the bottom of an indentation in the perforated body (55) between the first face (59) and the second face (62).

3. A perforated body as defined by claim 2, in which the step (80) comprises the bottom of a blind bore (98, 99).

4. A perforated body as defined by claim 2, in which the step (80) comprises the bottom of a groove (82).

5. A perforated body as defined by claim 2, in which the third plane (93) is disposed at an angle to at least one of said first and said second plane (92).

6. A perforated body as defined by claim 5, in which the step (80) located in the third plane (93) comprises the bottom of a wedge-shaped notch (95) disposed between the first plane (91) and the second plane (92).

7. A perforated body as defined by claim 1, in which the step (80) comprises a protrusion (100).

8. A perforated body as defined by claim 1, in which said injection openings (54*a*, 54*b*) have center axes (83*a*,

*b*) which are inclined to various extents with respect to a longitudinal axis of the fuel injection valve.

9. A perforated body as defined by claim 1, in which the perforated body (55) comprises a separate part adhered to said second face.

10. A perforated body as defined by claim 9, in which the perforated body (55) takes the form of a lamina.

11. A perforated body as defined by claim 1, in which the perforated body (55) comprises a component part of a nozzle body (9) of the fuel injection valve, which nozzle body receives the valve seat (48).

12. A perforated body as defined by claim 1, in which said perforated body (55) is a separate part positioned between said nozzle body (9) and said preparation sleeve (58).

13. A perforated body as defined by claim 3, in which said perforated body (55) is a separate part positioned between said nozzle body (9) and said preparation sleeve (58).

14. A perforated body as defined by claim 12, in which said perforated body (55) is in the form of a lamina.

* * * * *